US008044599B2

(12) United States Patent
Chang et al.

(10) Patent No.: US 8,044,599 B2
(45) Date of Patent: Oct. 25, 2011

(54) LIGHT STRING WITH ALTERNATE LED LAMPS AND INCANDESCENT LAMPS

(76) Inventors: Chu-Cheng Chang, Hsinchu (TW); Cheng-Fen Chang, Hsinchu (TW); Chen-Hsien Chang, Hsinchu (TW); Chen-Tao Chang, Hsinchu (TW)

( * ) Notice: Subject to any disclaimer, the term of this patent is extended or adjusted under 35 U.S.C. 154(b) by 447 days.

(21) Appl. No.: 12/379,214

(22) Filed: Feb. 17, 2009

(65) Prior Publication Data

US 2010/0207533 A1 Aug. 19, 2010

(51) Int. Cl.
*H05B 37/00* (2006.01)

(52) U.S. Cl. ..... 315/192; 315/185 R; 315/185 S; 315/179; 315/312; 362/249.06; 362/227; 362/234

(58) Field of Classification Search ..... 315/178, 315/179, 185 R, 185 S, 192, 200 R, 291, 315/312; 362/249.06, 227, 234, 253, 800
See application file for complete search history.

(56) References Cited

U.S. PATENT DOCUMENTS

| | | | | |
|---|---|---|---|---|
| 4,675,575 | A * | 6/1987 | Smith et al. | 315/185 S |
| 5,374,876 | A * | 12/1994 | Horibata et al. | 315/313 |
| 5,632,550 | A * | 5/1997 | Yeh | 362/123 |
| 5,639,157 | A * | 6/1997 | Yeh | 362/567 |
| 6,344,716 | B1 * | 2/2002 | Gibboney, Jr. | 315/185 S |
| 7,029,145 | B2 * | 4/2006 | Frederick | 362/234 |
| 7,609,006 | B2 * | 10/2009 | Gibboney | 315/200 R |
| 2008/0130283 | A1 * | 6/2008 | Chang | 362/249 |

* cited by examiner

*Primary Examiner* — Haiss Philogene

(57) ABSTRACT

In one embodiment an electrical circuit for use as a string of lights includes a load comprising a plurality of lamps connected in series, the lamps comprising a first group of lamps including an LED and a first Zener diode in parallel therewith, and a second group of lamps including an incandescent light bulb and a second Zener diode in parallel therewith; and a rectifier for converting a source of AC into DC which is supplied to the load. The first group of lamps are alternate with the second group of lamps.

10 Claims, 17 Drawing Sheets

LIGHT STRING WITH ALTERNATE LED LAMPS AND INCANDESCENT LAMPS

BACKGROUND OF THE INVENTION

1. Field of Invention

The invention relates to providing electrical power to a plurality of low voltage electrical loads, and more particularly to a string of lights includes a load comprising a plurality of lamps connected in series, the lamps comprising a first group of lamps including an LED and a first Zener diode in parallel therewith, and a second group of lamps including an incandescent light bulb and a second Zener diode in parallel therewith in which the first group of lamps are alternate with the second group of lamps.

2. Description of Related Art

LEDs are renowned for their long life and their ability to resist shock. Also, an LED consumes much less electrical power than fluorescent lamps (i.e., energy saving). Therefore, LED lighting devices are gaining popularity worldwide.

A typical string of lights including a plurality of LED bulbs arranged electrically in a series circuit is shown in FIG. 1. AC (alternating current) 120V is rectified by a full-wave rectifier (e.g., bridge rectifier as shown) to convert into DC (direct current) to be consumed by the plurality of LED bulbs. However, the well known light string suffers from a disadvantage. In detail, one LED bulb of the string burning out will kill the circuit. For example, the light string comprises 40 blue LED bulbs of 3V 0.02 A. Any burned out blue LED bulb will kill the circuit with the remaining 39 blue LED bulbs being disabled.

A typical string of lights including a plurality of (e.g., 40) incandescent light bulbs arranged electrically in a series circuit is shown in FIG. 2. AC 120V is fed to the 40 incandescent light bulbs for consumption. However, the well known light string suffers from a disadvantage. In detail, one incandescent light bulb of the string burning out will kill the circuit. For example, the light string comprises 40 incandescent light bulbs of 3V 0.1 A. Any burned out incandescent light bulb will kill the circuit with the remaining 39 incandescent light bulbs being disabled.

Another typical string of lights including a plurality of (e.g., 35) white LED bulbs of 3.2V 0.02 A arranged electrically in a parallel circuit is shown in FIG. 3. AC 120V is rectified by a full-wave rectifier 15 to convert into DC to be consumed by the plurality of white LED bulbs.

However, the well known light string still suffers from a disadvantage. In detail, electric current is required to increase as the number of white LED bulbs increases. The total current (e.g., I) of the circuit can be expressed as a multiplication of current (e.g., $I_f$) flowing through each white LED bulb times the number of white LED bulbs (e.g., N). As shown, AC 120V is rectified by the full-wave rectifier 15 to convert into DC (e.g., DC 3.2V 0.7 A) to be consumed by the 35 white LED bulbs. For example, operating voltage of the white LED bulb is 3.2V and operating current thereof is 0.02 A. Hence, the total current (I) is 0.02 A×35 equal to 0.7 A. Advantageously, the circuit will maintain its normal operation if, for example, one white LED bulb is burned out. That is, the remaining 34 white LED bulbs still emit light. However, cost of developing such type of full-wave rectifier capable of converting, for example, AC 120V into DC (e.g., DC 3.2V 0.7 A) to be consumed by the LED bulbs is very high. Hence, it may adversely affect competitiveness of such light string in the market.

Another typical string of lights including a plurality of (e.g., 35) incandescent light bulbs of 3.2V 0.08 A arranged electrically in a parallel circuit is shown in FIG. 4.

However, the well known light string still suffers from a disadvantage. In detail, electric current is required to increase as the number of incandescent light bulbs increases. As shown, AC 120V is rectified by a full-wave rectifier 15 to convert into DC (e.g., DC 3.2V 2.8 A) to be consumed by the 35 incandescent light bulbs. For example, operating voltage of the incandescent light bulb is 3.2V and operating current thereof is 0.08 A. Hence, the total current (I) is 0.08 A×35 equal to 2.8 A. Advantageously, the circuit will maintain its normal operation if, for example, one incandescent light bulb is burned out. That is, the remaining 34 incandescent light bulbs still emit light. However, cost of developing such type of full-wave rectifier capable of converting, for example, AC 120V into DC (e.g., DC 3.2V 2.8 A) to be consumed by the incandescent light bulbs is very high. Hence, it may adversely affect competitiveness of such light string in the market.

There have been numerous suggestions in prior patents for light string. For example, U.S. Pat. No. 6,344,716 discloses a Christmas light string. Thus, continuing improvements in the exploitation of light string are constantly being sought.

SUMMARY OF THE INVENTION

It is therefore one object of the invention to provide an electrical circuit for use as a string of lights, comprising a load comprising a plurality of lamps connected in series, the lamps comprising a first group of lamps including an LED and a first Zener diode in parallel therewith, and a second group of lamps including an incandescent light bulb and a second Zener diode in parallel therewith; and a rectifier for converting a source of AC (alternating current) into DC (direct current) which is supplied to the load, wherein the first group of lamps are alternate with the second group of lamps.

It is another object of the invention to provide an electrical circuit for use as a string of lights, comprising a load comprising a plurality of lamps connected in series, the lamps comprising a first group of lamps including an LED and a first bi-directional Zener diode in parallel therewith, and a second group of lamps including an incandescent light bulb and a second bi-directional Zener diode in parallel therewith, wherein the load is activated by a source of AC (alternating current); and wherein the first group of lamps are alternate with the second group of lamps.

It is a further object of the invention to provide an electrical circuit for use as a string of lights, comprising a load comprising a plurality of lamps connected in series, the lamps comprising a first group of lamps including an LED and a first Zener diode in parallel therewith, and a second group of lamps including an incandescent light bulb and a second Zener diode in parallel therewith, wherein the load is activated by a source of AC (alternating current); and wherein the first group of lamps are alternate with the second group of lamps.

The above and other objects, features and advantages of the invention will become apparent from the following detailed description taken with the accompanying drawings.

DETAILED DESCRIPTION OF THE INVENTION

Figure 1:
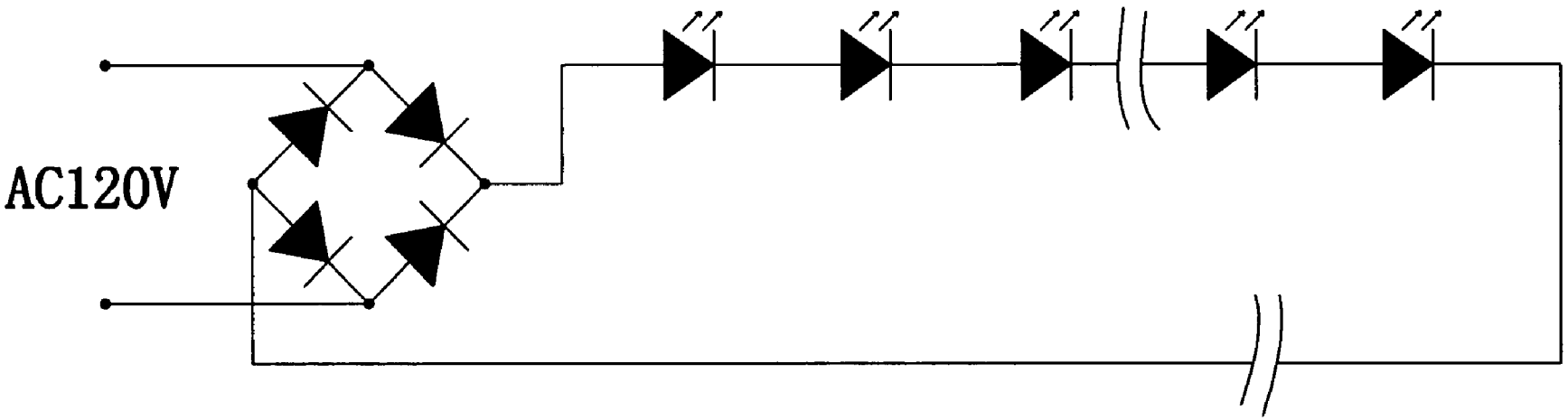
Fig. 1 PRIOR ART
FIG. 1 is a circuit diagram of a typical LED light string with lamps arranged in series.
Figure 2:
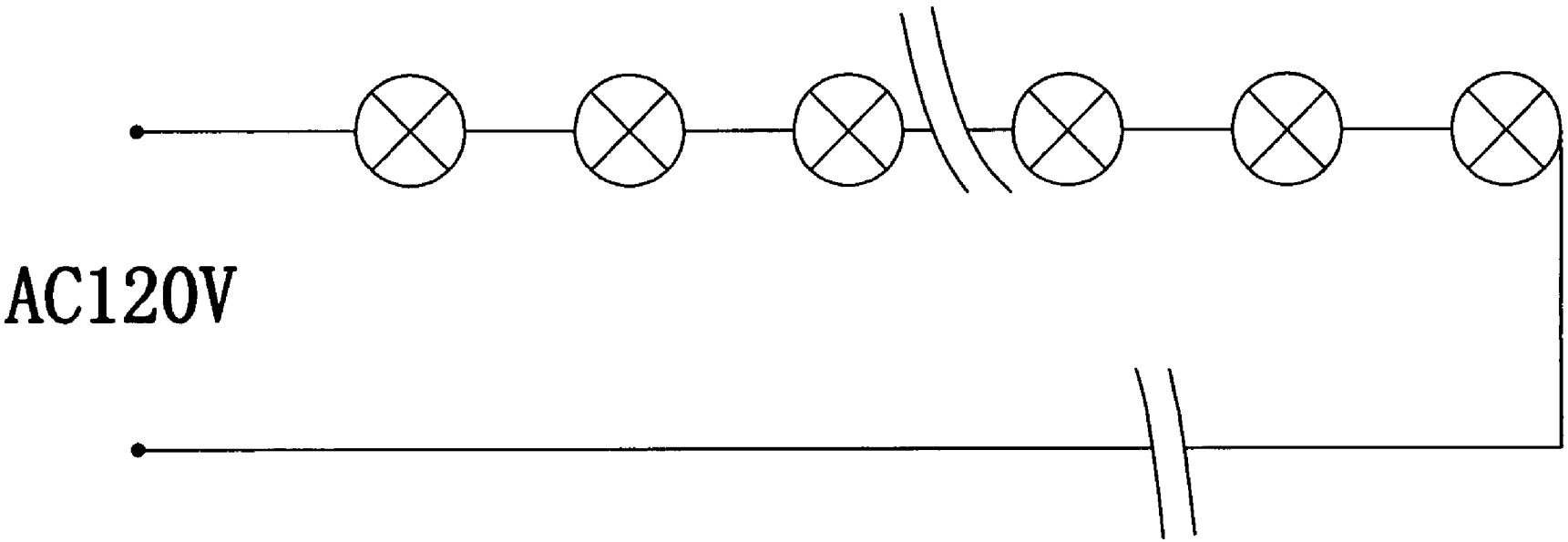
Fig. 2 PRIOR ART
FIG. 2 is a circuit diagram of a typical string of light including a plurality of incandescent light bulbs arranged in series.
Figure 3:
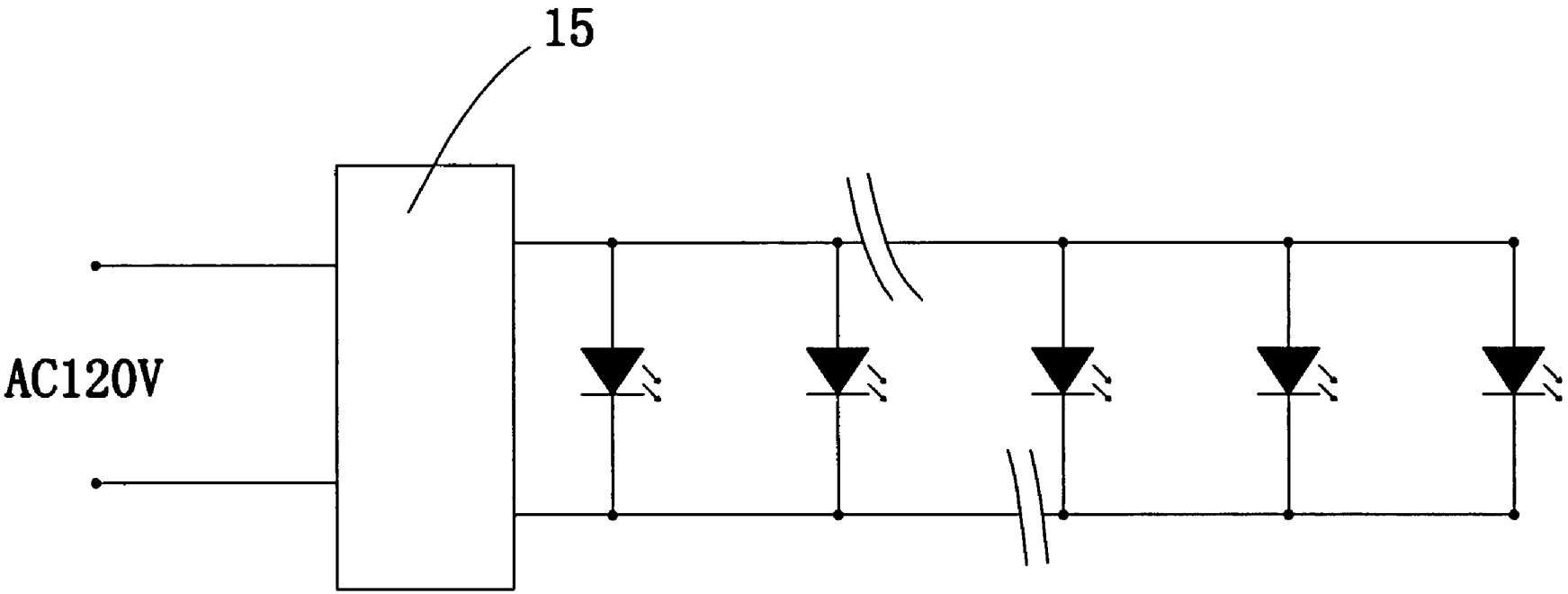
Fig. 3 PRIOR ART
FIG. 3 is a circuit diagram of another typical LED light string with lamps arranged in parallel.
Figure 4:
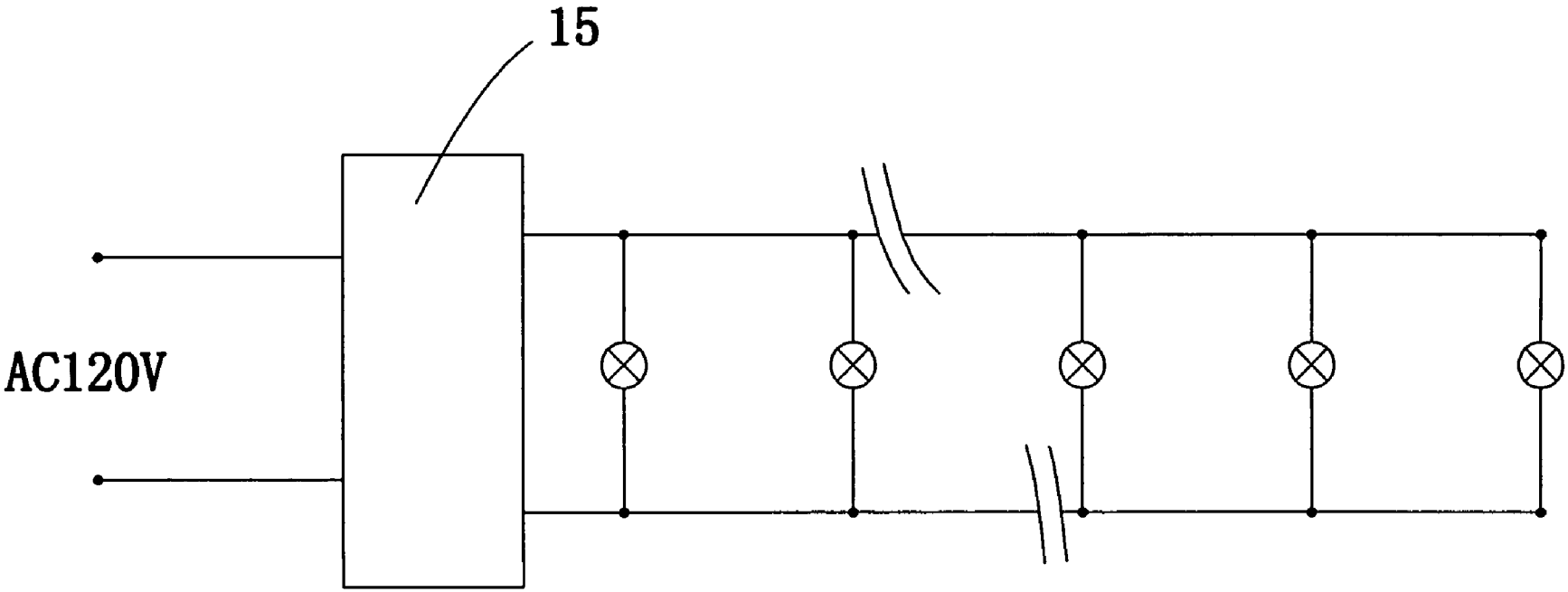
Fig. 4 PRIOR ART
FIG. 4 is a circuit diagram of another typical string of light including a plurality of incandescent light bulbs arranged in parallel.
Figure 5:
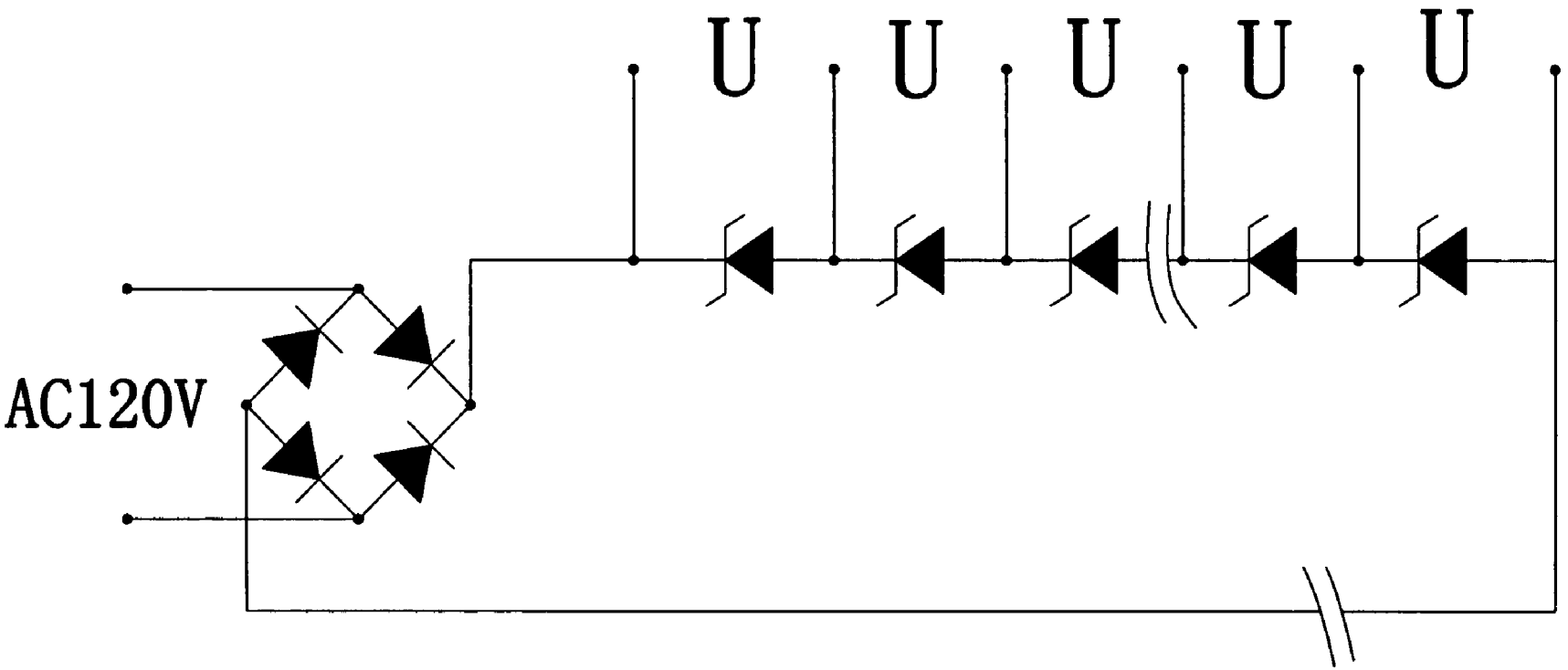
FIG. 5 is a schematic circuit diagram of a string of lights according to the invention.

Referring to FIG. 5, a string of lights according to the invention is shown. As shown, AC input is AC 120V and the string of lights comprises a plurality of lamps U.

Figure 6:
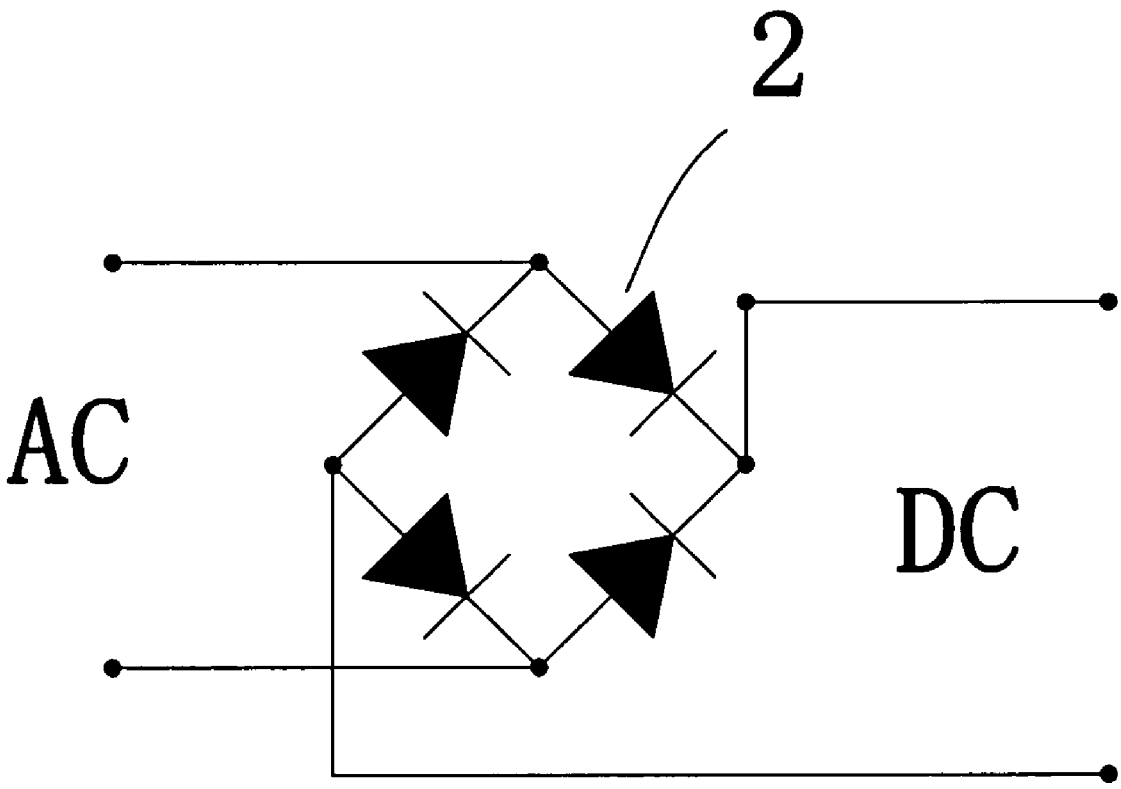
FIG. 6 is a circuit diagram of a first preferred embodiment of rectifier according to the invention.

Referring to FIG. 6, a first preferred embodiment of rectifier 2 according to the invention is shown. The rectifier 2 is implemented as a full-wave rectifier and is adapted to convert AC source (e.g., AC 120V) into DC 120V (i.e., operating voltage) to be consumed by the lamps U of the string of lights shown in FIG. 5.

Figure 7:
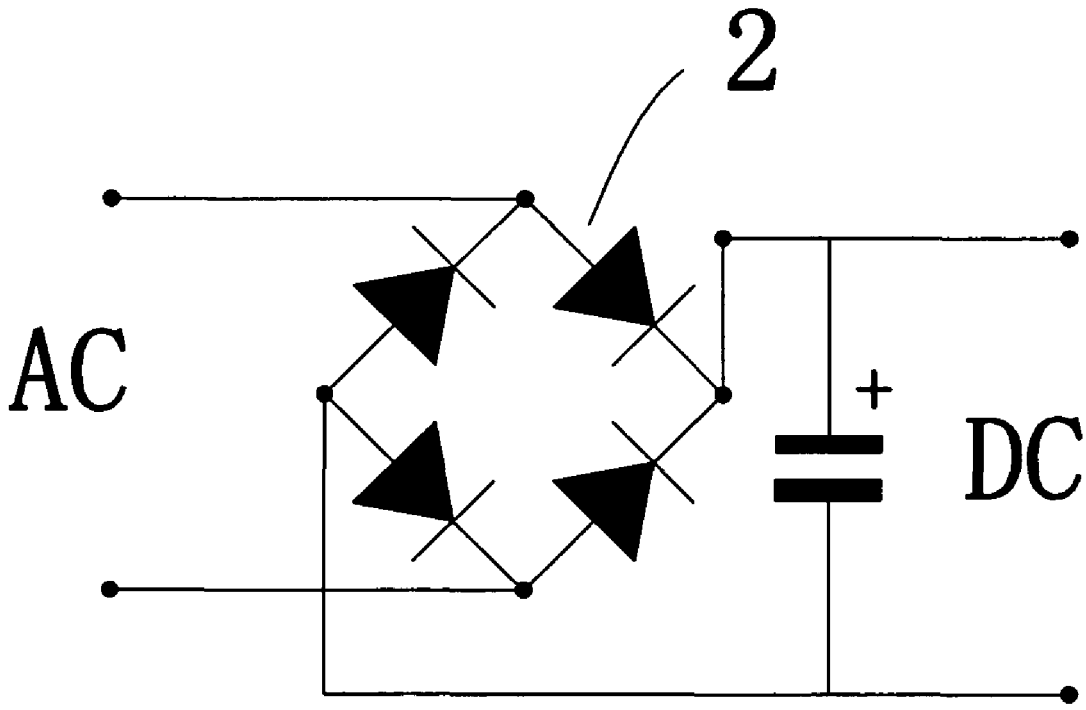
FIG. 7 is a circuit diagram of a second preferred embodiment of rectifier according to the invention.

Referring to FIG. 7, a second preferred embodiment of rectifier 2 according to the invention is shown. The rectifier 2 is implemented as a full-wave rectifier and is adapted to convert AC source (e.g., AC 120V) into DC 120V (i.e., operating voltage). A capacitor (not numbered) is provided as a filter and is electrically connected in parallel with the output of the rectifier 2. The provision of the capacitor aims at smoothing waveshape of the rectifier output. The DC output is to be consumed by the lamps U of the string of lights shown in FIG. 5.

Figure 8:
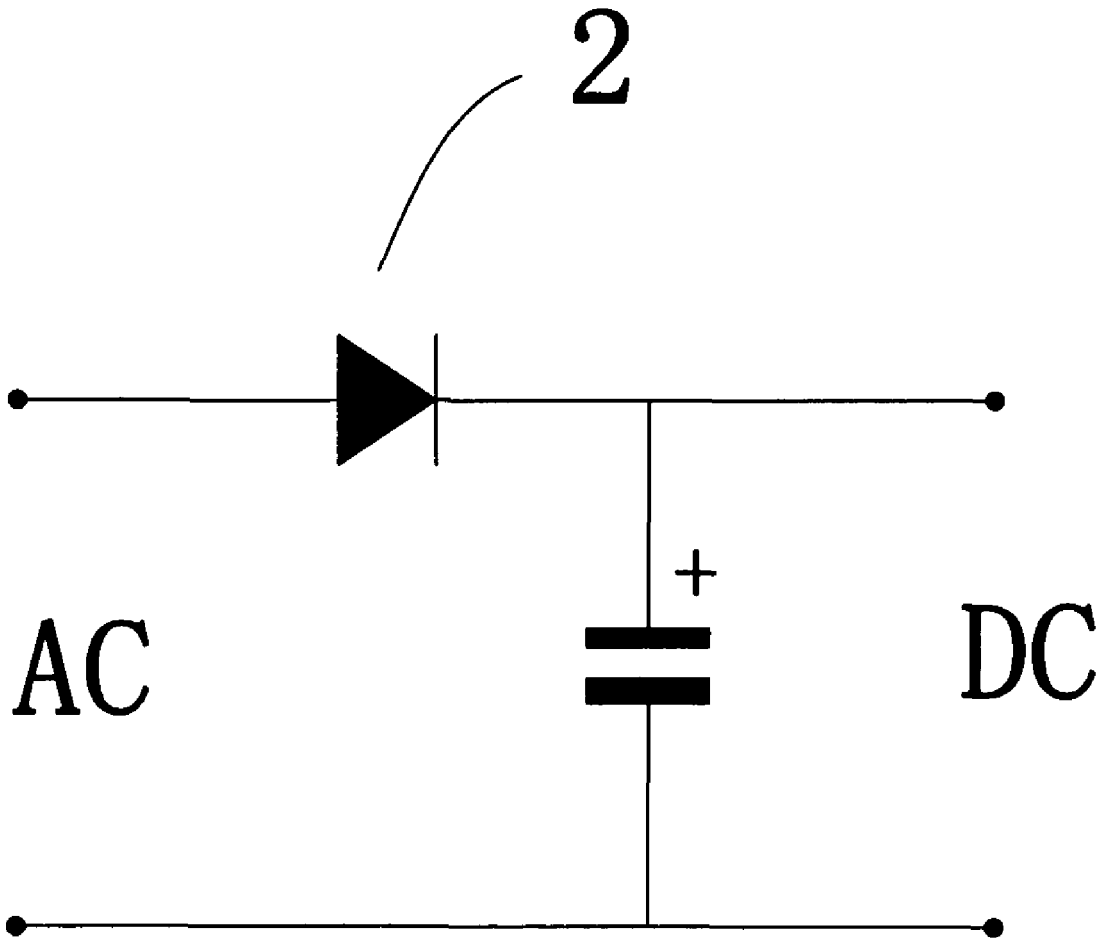
FIG. 8 is a circuit diagram of a third preferred embodiment of rectifier according to the invention.

Referring to FIG. 8, a third preferred embodiment of rectifier 2 according to the invention is shown. The rectifier 2 is implemented as a half-wave rectifier and is adapted to convert AC source (e.g., AC 120V) into DC 120V (i.e., operating voltage). A capacitor (not numbered) is provided as a filter and is electrically connected in parallel with the output of the rectifier 2. The provision of the capacitor aims at smoothing waveshape of the rectifier output. The DC output is to be consumed by the lamps U of the string of lights shown in FIG. 5.

Figure 9:
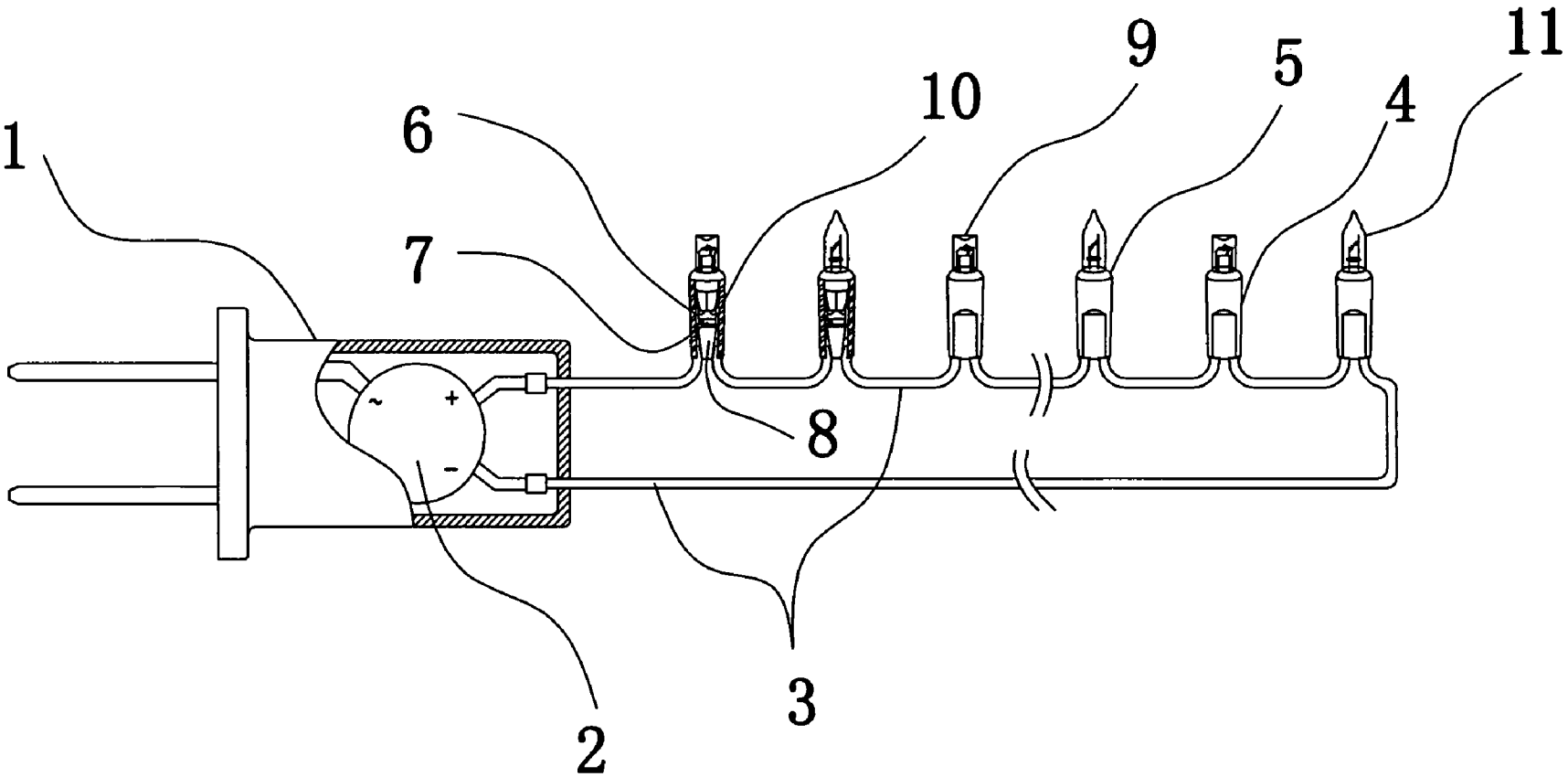
FIG. 9 is an illustration of a first configuration of the string of lights of FIG. 5.

Referring to FIG. 9, the light string comprises a plug 1 having positive and negative prongs (not numbered), a rectifier 2 as one shown in FIG. 7, FIG. 8, or FIG. 9 being mounted inside the plug 1, and a plurality of lamps 4 electrically connected together between positive terminal of the rectifier 2 and negative terminal thereof through a cord 3 to construct a complete circuit. The lamps 4 comprise a plurality of lamps 4 having an LED 9 and a plurality of lamps 4 having an incandescent light bulb 11 which are disposed alternately with the lamps having the LED 9.

Figure 10:
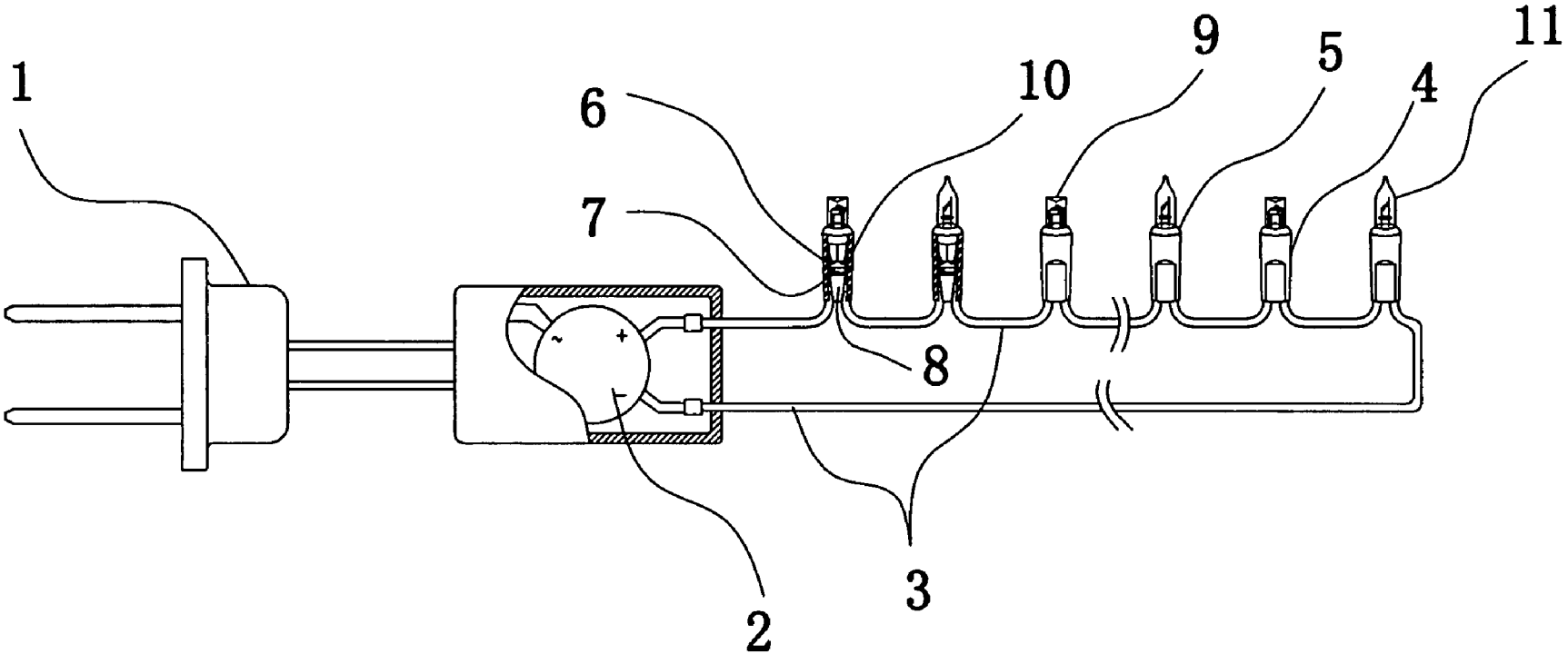
FIG. 10 is an illustration of a second configuration of the string of lights of FIG. 5.

Referring to FIG. 10, the light string comprises a plug 1 having positive and negative prongs (not numbered), a rectifier 2 as one shown in FIG. 7, FIG. 8, or FIG. 9 being formed separately from the plug 1, and a plurality of lamps 4 electrically connected together between positive terminal of the rectifier 2 and negative terminal thereof through a cord 3 to construct a complete circuit. The lamps 4 comprise a plurality of lamps 4 having an LED 9 and a plurality of lamps 4 having an incandescent light bulb 11 which are disposed alternately with the lamps having the LED 9.

Figure 11:
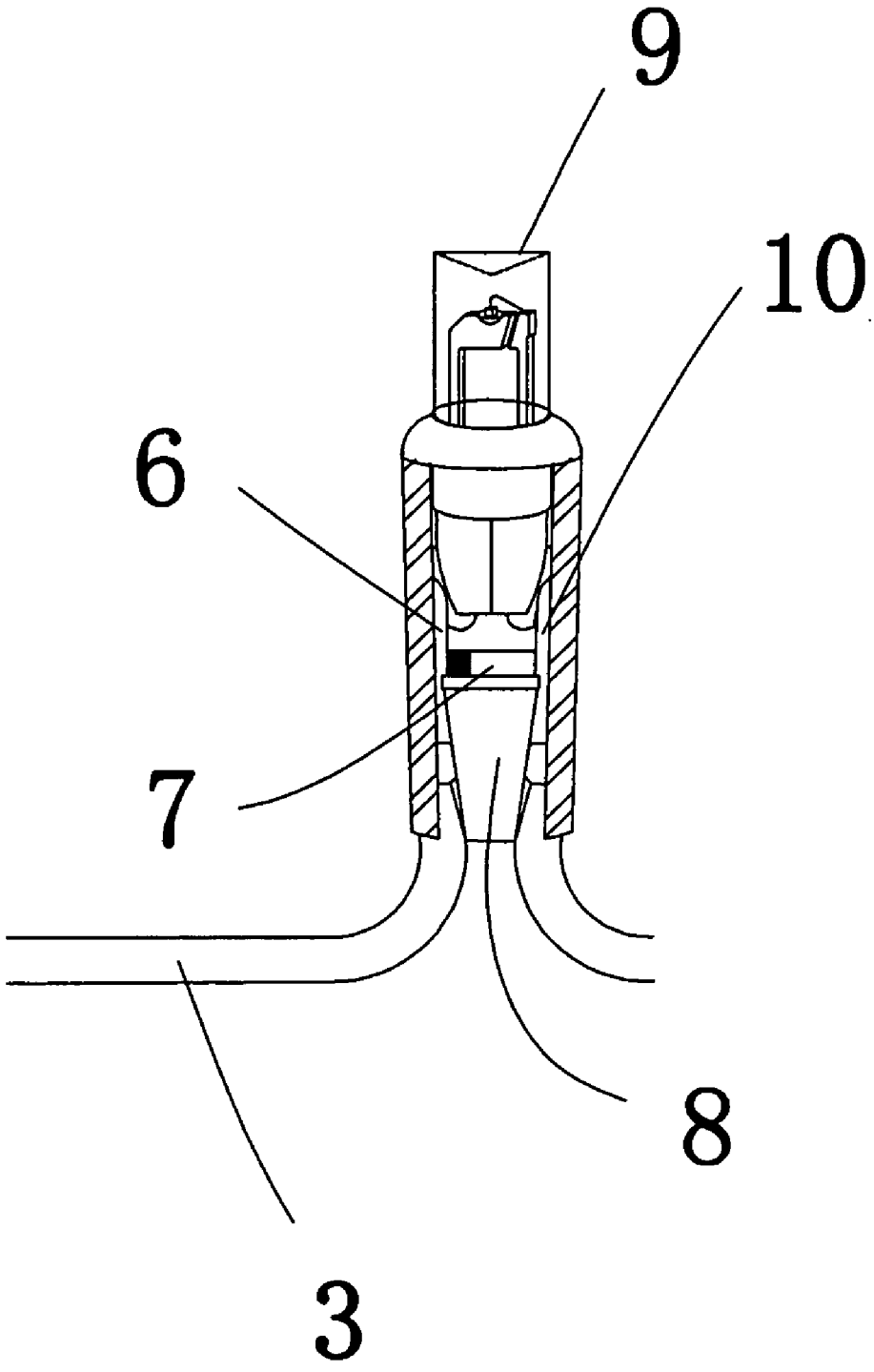
FIG. 11 is an enlarged view of the lamp of FIG. 9.

Referring to FIG. 11 in conjunction with FIG. 9, the lamp 4 comprises a seat 8, a first contact 6 connected to one end of a section of the cord 3, a second contact 10 connected to one end of another section of the cord 3, a Zener diode 7 secured onto the seat 8 and interconnecting the contacts 6, 10, a top cap 5 formed of flexible material, and an exposed LED 9 secured onto the cap 5 and interconnecting the contacts 6, 10.

Figure 12:
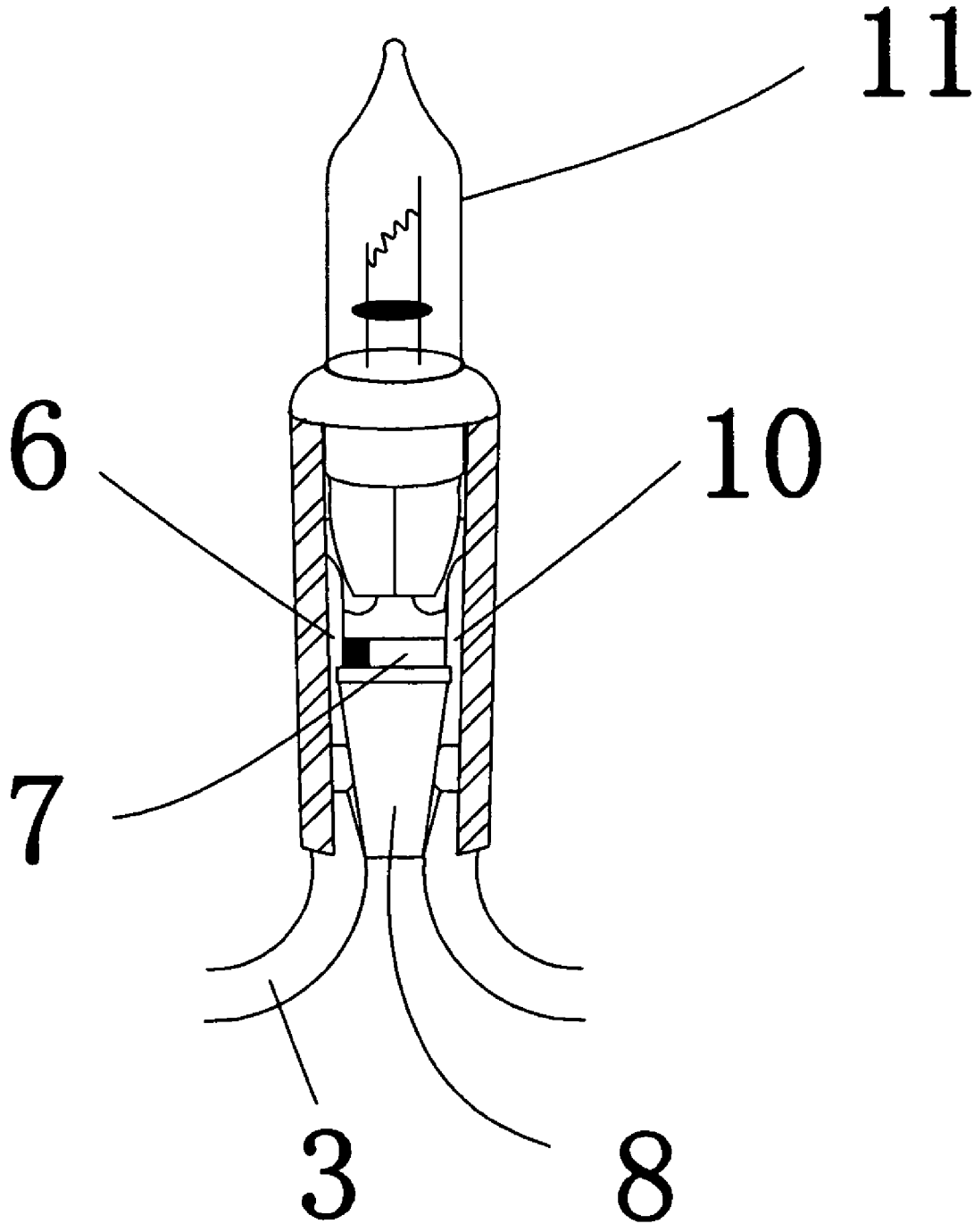
FIG. 12 is an enlarged view of the lamp of FIG. 10.

Referring to FIG. 12 in conjunction with FIG. 10, the lamp 4 comprises a seat 8, a first contact 6 connected to one end of a section of the cord 3, a second contact 10 connected to one end of another section of the cord 3, a Zener diode 7 secured onto the seat 8 and interconnecting the contacts 6, 10, a top cap 5 formed of flexible material, and an exposed incandescent light bulb 11 secured onto the cap 5 and interconnecting the contacts 6, 10.

Figure 13:
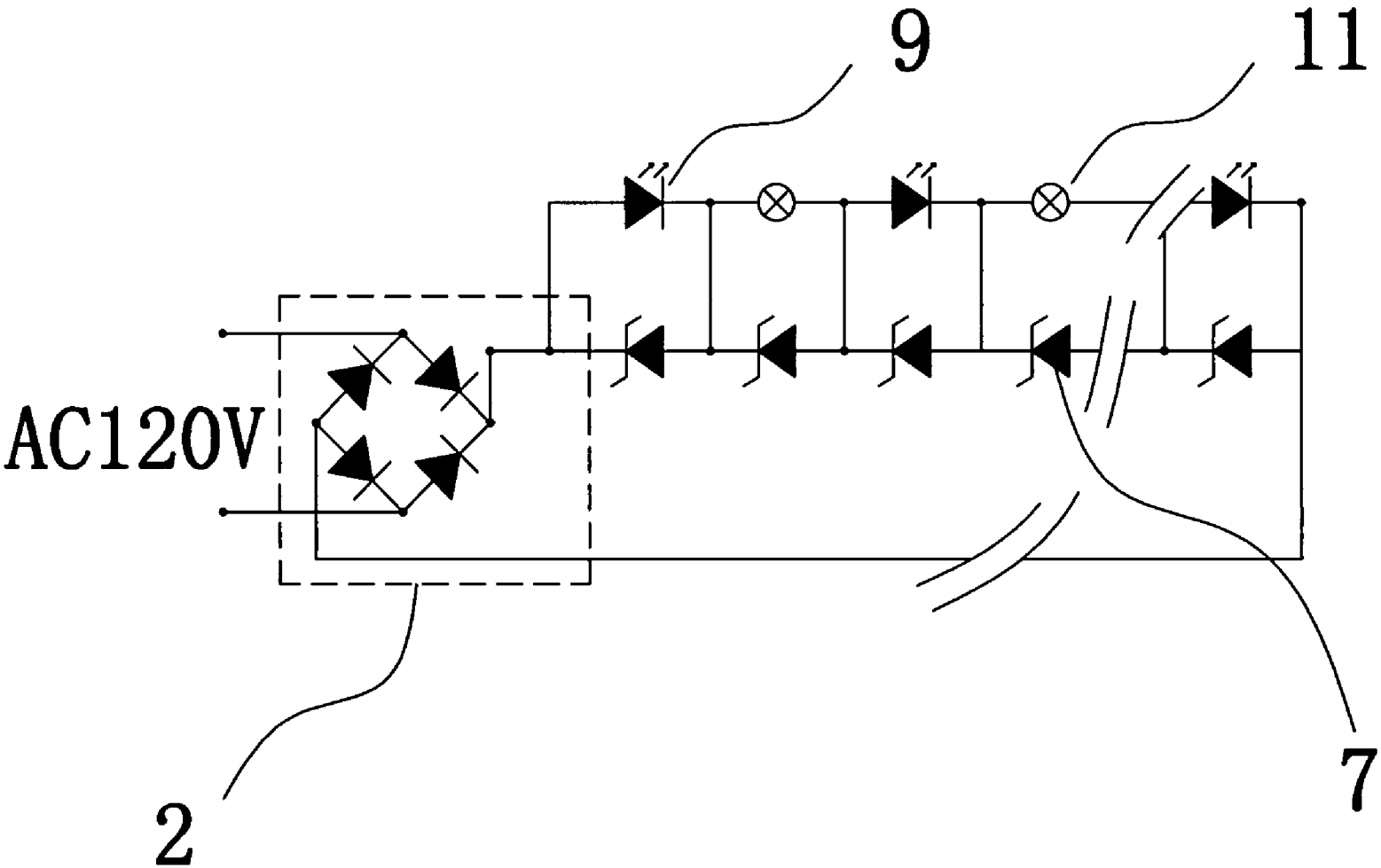
FIGS. 13, 14, and 15 are circuit diagrams of the string of lights incorporating the first, second, and third preferred embodiments of rectifier according to the invention respectively.

Referring to FIG. 13, it shows a circuit diagram of the string of lights incorporating the first preferred embodiment of rectifier 2 according to the invention. The load of the circuit (i.e., the string of lights), i.e., a plurality of alternate lamps of LED 9 and incandescent light bulb 11 and a plurality of Zener diodes 7, is coupled to the rectifier output.

The cathode of the Zener diode 7 proximate the rectifier 2 is connected to the positive terminal of the rectifier output and the anode of the Zener diode 7 distal the rectifier 2 is connected to the negative terminal of the rectifier output. The alternate lamps of LED 9 and incandescent light bulb 11 are electrically connected in parallel with the Zener diode 7 with both the anode of the Zener diode 7 and the cathode of an adjacent Zener diode 7 connected to both the cathode of the LED 9 and the incandescent light bulb 11. For the circuit, the Zener diodes 7 are connected in series and the alternate lamps of LED 9 and incandescent light bulb 11 also are connected in series, i.e., the lamp having an LED 9 being electrically connected in parallel with the Zener diode 7 and the lamp having an incandescent light bulb 11 being also electrically connected in parallel with the Zener diode 7.

The Zener diode 7 is used as a voltage stabilizer for the LED 9. Hence, only low current in a safe range flows through the LEDs 9. As a result, the LEDs 9 can operate normally for a prolonged period of time. Hence, the life time of the light string is prolonged greatly. The rectifier 2 is adapted to convert AC 120V into DC 120V.

In this embodiment, the Zener diode 7 has a breakdown voltage of 5V in the reverse direction. Breakdown voltage of 5V is equal to or larger than an operating voltage of LED 9. The LEDs 9 are adapted to emit white light and have an operating voltage of DC 5V and an operating current of 0.02 A. The incandescent light bulb 11 has an operating voltage of DC 5V and an operating current of 0.08 A. Advantageously, the current will bypass any burned out LED 9 or incandescent light bulb 11 to flow through its parallel Zener diode 7 (i.e., shunt). Hence, the circuit still maintain in a normal operation.

Figure 14:
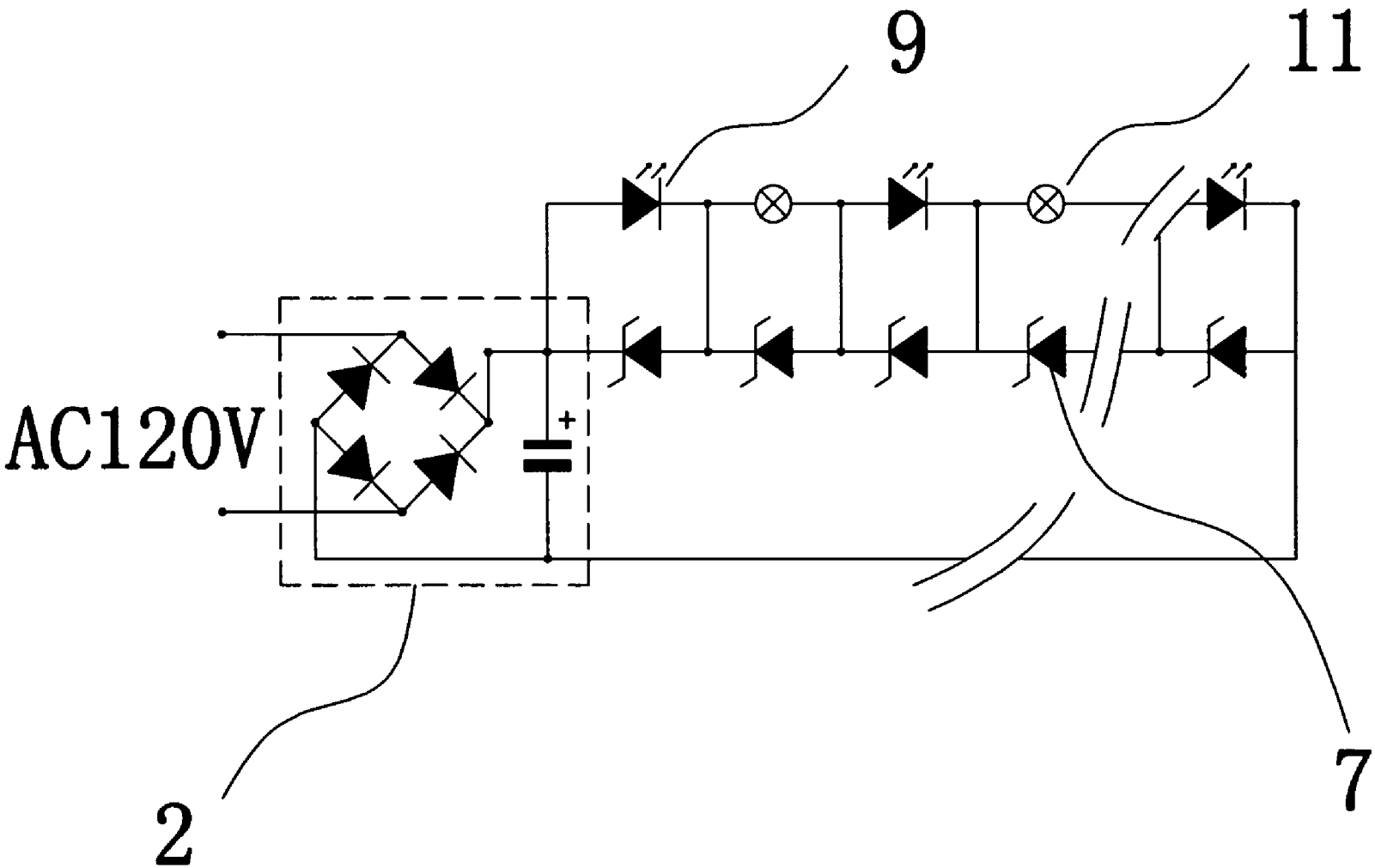

Referring to FIG. 14, it shows a circuit diagram of the string of lights incorporating the second preferred embodiment of rectifier 2 according to the invention. The load of the circuit (i.e., the string of lights), i.e., a plurality of alternate lamps of LED 9 and incandescent light bulb 11 and a plurality of Zener diodes 7, is coupled to the capacitor (not numbered) which is electrically connected in parallel with the rectifier output.

The configuration of the Zener diodes 7, the LEDs 9, and the incandescent light bulbs 11 is identical to that described in FIG. 13. Accordingly, further description is omitted for purposes of brevity and convenience only, and is not limiting.

In this embodiment, the Zener diode 7 has a breakdown voltage of 8V in the reverse direction. Breakdown voltage of 8V is equal to or larger than an operating voltage of LED 9. The LEDs 9 are adapted to emit blue light and have an operating voltage of DC 8V and an operating current of 0.02 A. The incandescent light bulb 11 has an operating voltage of DC 8V and an operating current of 0.1 A. Advantageously, the current will bypass any burned out LED 9 or incandescent light bulb 11 to flow through its parallel Zener diode 7 (i.e., shunt). Hence, the circuit still maintain in a normal operation.

Figure 15:
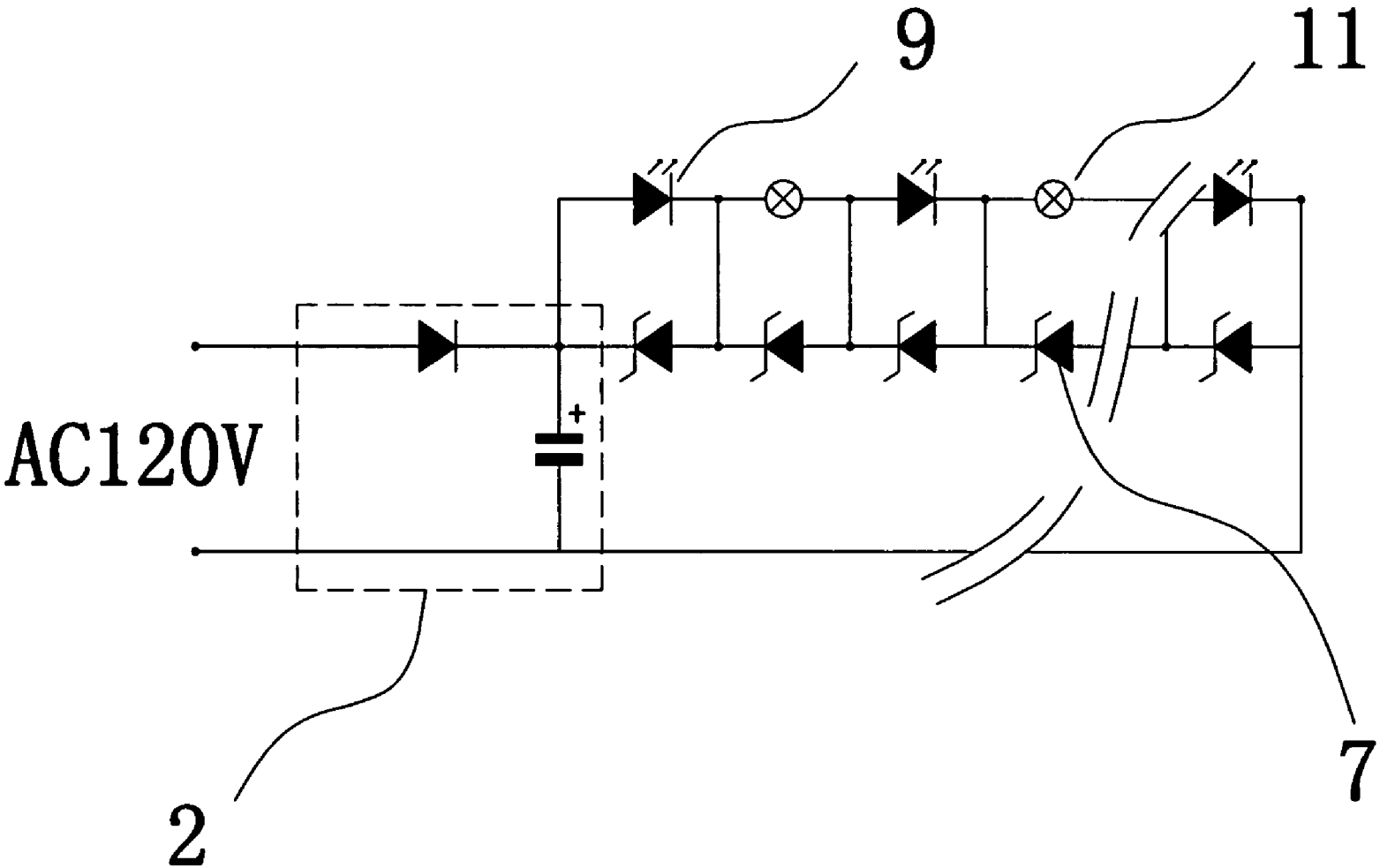

Referring to FIG. 15, it shows a circuit diagram of the string of lights incorporating the third preferred embodiment of rectifier 2 according to the invention. The load of the circuit (i.e., the string of lights), i.e., a plurality of alternate lamps of LED 9 and incandescent light bulb 11 and a plurality of Zener diodes 7, is coupled to the capacitor (not numbered) which is electrically connected in parallel with the rectifier output.

The configuration of the Zener diodes 7, the LEDs 9, and the incandescent light bulbs 11 is identical to that described in FIG. 13. Accordingly, further description is omitted for purposes of brevity and convenience only, and is not limiting.

In this embodiment, the Zener diode 7 has a breakdown voltage of 3.3V in the reverse direction. Breakdown voltage of 3.3V is equal to or larger than an operating voltage of LED 9. The LEDs 9 are adapted to emit red light and have an operating voltage of DC 3.3V and an operating current of 0.02 A. The incandescent light bulb 11 has an operating voltage of DC 3.3V and an operating current of 0.1 A. Advantageously, the current will bypass any burned out LED 9 or incandescent light bulb 11 to flow through its parallel Zener diode 7 (i.e., shunt). Hence, the circuit still maintain in a normal operation.

Note that any Zener diode described above can be replaced with a resistor in other embodiments.

Figure 16:
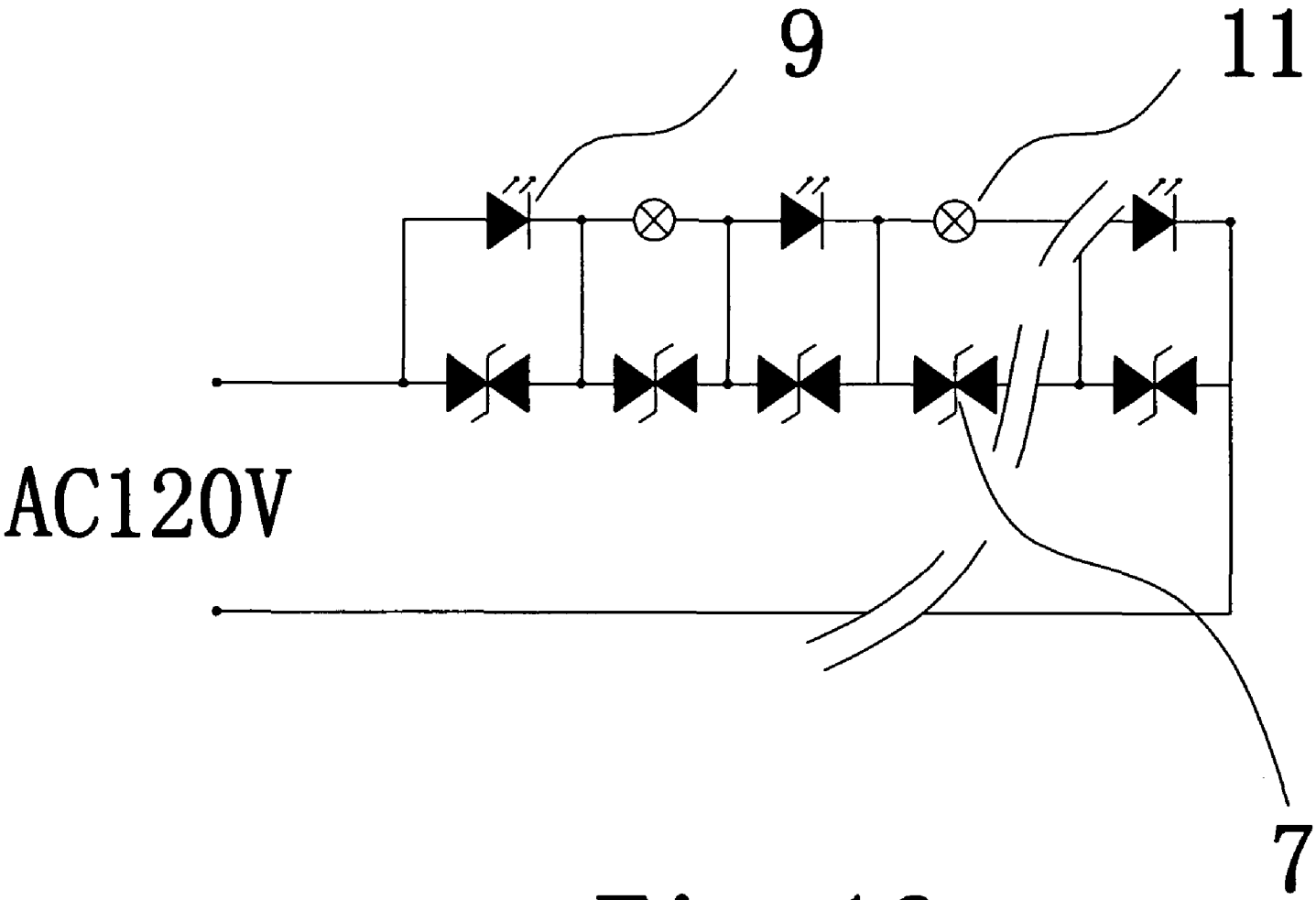
FIG. 16 is a circuit diagram of the string of lights without incorporating any of the first, second, and third preferred embodiments of rectifier according to the invention.

Referring to FIG. 16, it shows a schematic circuit diagram of a string of lights according to the invention which does not incorporate the first, second, or third preferred embodiment of rectifier discussed above. The Zener diodes 7 discussed above are one directional ones (i.e., forward biased ones). It is possible of replacing the one-directional Zener diodes with a plurality of two-directional Zener diodes 7.

The configuration of the Zener diodes 7, the LEDs 9, and the incandescent light bulbs 11 is generally identical to that described in FIG. 13. Accordingly, further description is omitted for purposes of brevity and convenience only, and is not limiting.

In this embodiment, the Zener diode 7 has a breakdown voltage of 3.3V in the reverse direction. Breakdown voltage of 3.3V is equal to or larger than an operating voltage of LED 9. The LEDs 9 are adapted to emit red light and have an operating voltage of DC 3.3V and an operating current of 0.02 A. The incandescent light bulb 11 has an operating voltage of DC 3.3V and an operating current of 0.12 A. Advantageously, the current will bypass any burned out LED 9 or incandescent light bulb 11 to flow through its parallel Zener diode 7 (i.e., shunt). Hence, the circuit still maintain in a normal operation.

Figure 17:
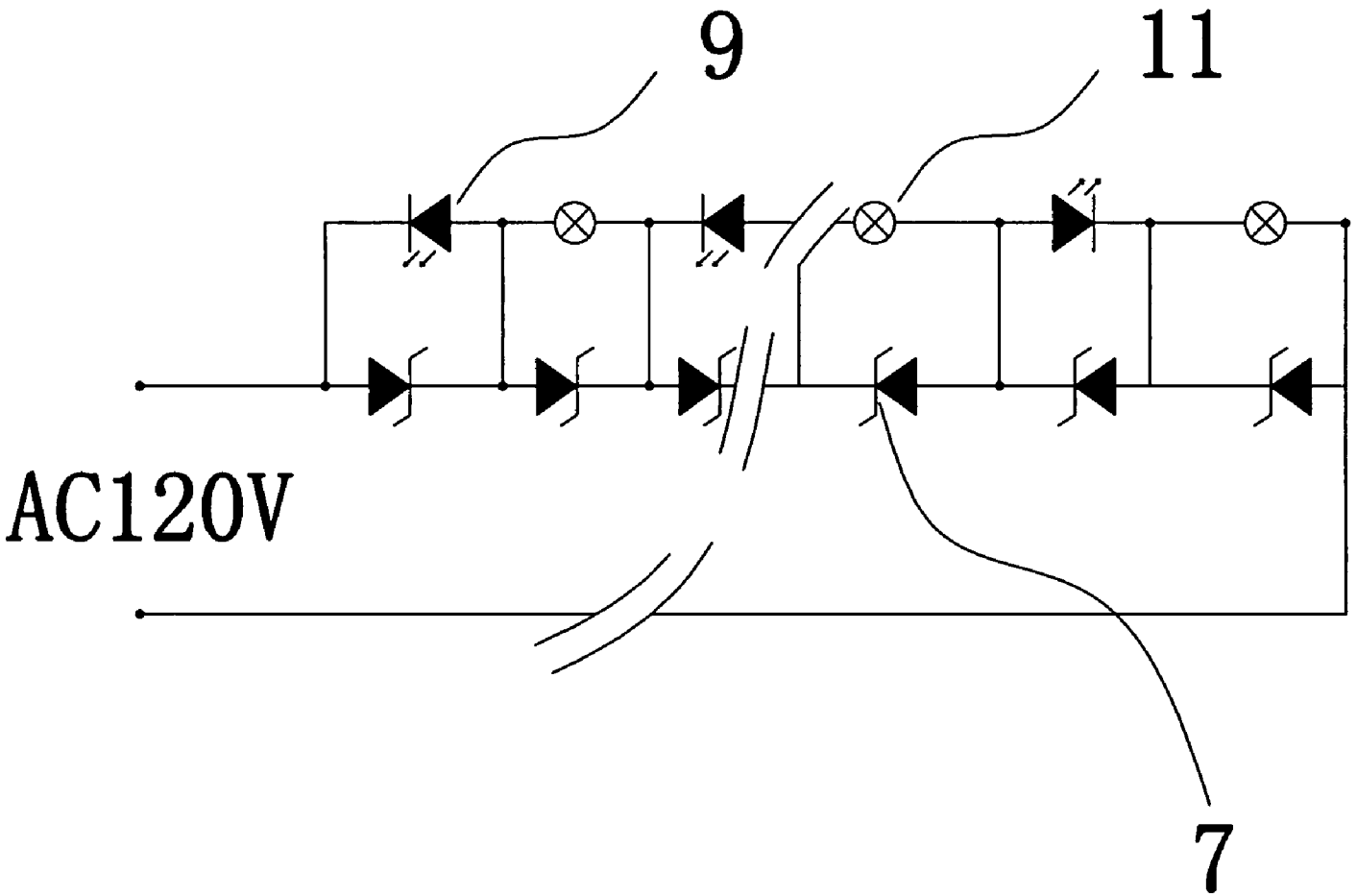
FIG. 17 is another circuit diagram of the string of lights without incorporating any of the first, second, and third preferred embodiments of rectifier according to the invention.

Referring to FIG. 17, it shows a schematic circuit diagram of a string of lights according to the invention which does not incorporate the first, second, or third preferred embodiment of rectifier discussed above.

The load of the circuit (i.e., the string of lights), i.e., a plurality of alternate lamps of LED 9 and incandescent light bulb 11 and a plurality of Zener diodes 7, is coupled to the rectifier output.

The Zener diodes 7 are electrically connected in series and divided into first and second groups. The lamps of LED 9 and incandescent light bulb 11 are also divided into corresponding first and second groups.

The first groups of the Zener diodes 7, the LEDs 9, and the incandescent light bulbs 11 are shown in the left side of FIG. 17 and are detailed below. The anode of the Zener diode 7 proximate the AC 120V source (i.e., AC source) is connected to both the positive terminal of the AC 120V source and the cathode of the LED 9 and the cathode thereof is connected to the anode of the LED 9. For the remaining LEDs 9 and the incandescent light bulbs 11, the anode of each of the remaining Zener diodes 7 is either connected to both the anode of the LED 9 and the incandescent light bulb 11 or connected to both the cathode of the LED 9 and the incandescent light bulb 11 in an alternate fashion.

The second groups of the Zener diodes 7, the LEDs 9, and the incandescent light bulbs 11 are shown in the right side of FIG. 17 and are detailed below. The anode of the Zener diode 7 distal the AC source is connected to both the negative terminal of the AC 120V source and the incandescent light bulb 11 and the cathode thereof is connected to both the cathode of the LED 9 and the incandescent light bulb 11. For the remaining LEDs 9 and the incandescent light bulbs 11, the anode of each of the remaining Zener diodes 7 is either connected to both the cathode of the LED 9 and the incandescent light bulb 11 or connected to both the anode of the LED 9 and the incandescent light bulb 11 in an alternate fashion.

The configuration of the Zener diodes 7, the LEDs 9, and the incandescent light bulbs 11 is generally identical to that described in FIG. 13. Accordingly, further description is omitted for purposes of brevity and convenience only, and is not limiting.

In this embodiment, the Zener diode 7 has a breakdown voltage of 5.0V in the reverse direction. Breakdown voltage of 5.0V is equal to or larger than an operating voltage of LED 9. The LEDs 9 are adapted to emit red light and have an operating voltage of DC 5.0V and an operating current of 0.02 A. The incandescent light bulb 11 has an operating voltage of DC 5.0V and an operating current of 0.1 A. Advantageously, the current will bypass any burned out LED 9 or incandescent light bulb 11 to flow through its parallel Zener diode 7 (i.e., shunt). Hence, the circuit still maintain in a normal operation.

While the invention herein disclosed has been described by means of specific embodiments, numerous modifications and variations could be made thereto by those skilled in the art without departing from the scope and spirit of the invention set forth in the claims.

What is claimed is:

1. An electrical circuit for use as a string of lights, comprising:

a load comprising a plurality of lamps connected in series, the lamps comprising a first group of lamps including an LED and a first electrical element in parallel therewith, and a second group of lamps including an incandescent light bulb and a second electrical element in parallel therewith; and a rectifier for converting a source of AC (alternating current) into DC (direct current) which is supplied to the load, wherein the first group of lamps are alternate with the second group of lamps.

2. The electrical circuit of claim 1, wherein the rectifier is a full-wave rectifier.

3. The electrical circuit of claim 1, wherein the rectifier is a full-wave rectifier electrically connected in parallel with a capacitor.

4. The electrical circuit of claim 1, wherein the rectifier is a half-wave rectifier electrically connected in parallel with a capacitor.

5. The electrical circuit of claim 1, wherein each of the first and second electrical elements is a Zener diode.

6. The electrical circuit of claim 1, wherein each of the first and second electrical elements is an electrical resistor.

7. An electrical circuit for use as a string of lights, comprising:

a load comprising a plurality of lamps connected in series, the lamps comprising a first group of lamps including an LED and a first electrical element in parallel therewith, and a second group of lamps including an incandescent light bulb and a second electrical element in parallel therewith, wherein the load is activated by a source of AC (alternating current); and wherein the first group of lamps are alternate with the second group of lamps.

8. The electrical circuit of claim 7, wherein each of the first and second electrical elements is a Zener diode.

9. The electrical circuit of claim 7, wherein each of the first and second electrical elements is an electrical resistor.

10. An electrical circuit for use as a string of lights, comprising:

a load comprising a plurality of lamps connected in series, the lamps comprising a first group of lamps including an LED and a first bi-directional Zener diode in parallel therewith, and a second group of lamps including an incandescent light bulb and a second bi-directional Zener diode in parallel therewith, wherein the load is activated by a source of AC (alternating current); and wherein the first group of lamps are alternate with the second group of lamps.

* * * * *